US005698825A

United States Patent [19]

Karasik

[11] Patent Number: 5,698,825

[45] Date of Patent: Dec. 16, 1997

[54] ELECTRICAL SWITCH

[75] Inventor: Boris Karasik, Walled Lake, Mich.

[73] Assignee: Lucas Industries, Solihull, United Kingdom

[21] Appl. No.: 552,990

[22] Filed: Nov. 3, 1995

[30] Foreign Application Priority Data

Nov. 8, 1994 [GB] United Kingdom ..... 9422459

[51] Int. Cl.[6] ..... H01H 9/26; H01H 19/00

[52] U.S. Cl. ..... 200/5 A; 200/6 A

[58] Field of Search ..... 200/5 A, 6 A

[56] References Cited

U.S. PATENT DOCUMENTS 4,687,200 8/1987 Shirai ..... 200/5 A 4,896,003 1/1990 Hsieh ..... 200/5 A 5,396,030 3/1995 Matsumiya et al. ..... 200/6 A 5,430,262 7/1995 Matsui et al. ..... 200/5 A 5,496,977 3/1996 Date et al. ..... 200/6 A

*Primary Examiner*—Stuart N. Hecker

*Attorney, Agent, or Firm*—Jacobson, Price, Holman & Stern, PLLC

[57] ABSTRACT

An electrical switch is described which comprises a housing, an operating member mounted on the housing for movement from a rest position in at least three directions relative to the housing, and at least three sets of electrical contacts, a respective set of contacts being operable by movement of said operating member away from the rest position in a respective one of said three directions. Each of the sets of contacts comprises a fixed contact and a movable contact, each of the movable contacts being carried by a common resilient annulus.

6 Claims, 1 Drawing Sheet

ELECTRICAL SWITCH

The present invention relates to a multi-way electrical switch of the kind in which a manually movable operating member can be moved in multiple directions from a rest position to complete, in use, respective electrical circuits.

An example of a known form of such a switch is a four-way rocker switch for use in a road vehicle to adjust electrically the position of the reflective element of a remotely positioned mirror assembly. The switch has a generally circular, centrally mounted rocker type operating member arranged such that pressure on the rocker member at any one of four, equiangularly spaced predetermined points around its periphery will cause the operating member to tilt about its central mounting in a direction appropriate to the point at which it is pressed, to operate a respective one of four resiliently mounted plungers. Each of the plungers has associated therewith a respective electrical contact set the contacts of which are closed by depression of the plunger against a resilient bias. Such known switches suffer from a large parts count and are correspondingly costly to manufacture and assemble. It is an object of the present invention to provide a multi-way switch wherein this, and other disadvantages of the prior art are minimised.

In accordance with the present invention there is provided an electrical switch comprising a housing, an operating member mounted on the housing for movement from a rest position in at least three different directions relative to the housing, and at least three electrical contact sets operable respectively by movement of the operating member from said rest position in a respective one of said three directions, each of said contact sets comprising a movable contact member and corresponding fixed contact means, and each of said movable contact members being carried by a common, resilient, annulus.

Preferably the fixed contact means of said contact sets are disposed on a planar member and said annulus is sinuous having equiangularly spaced crests and equiangularly spaced intervening troughs, the median plane of the annulus being disposed generally parallel to said planar member, and said movable contact members being associated with the crests of the annulus so as to be spaced, in the rest position of the annulus, from said planar member.

Desirably said annulus is anchored, adjacent its troughs, to said planar member.

Preferably said housing and said operating member cooperate to define planes of permitted movement of the operating member relative to the housing.

Preferably said annulus is electrically conductive and said movable contact members are integral parts thereof.

Desirably said annulus has four equiangularly spaced crests and four equiangularly spaced troughs, the troughs being equiangularly spaced between the crests, and said operating member has four permitted directions of movement relative to the housing.

One example of the invention as illustrated in the accompanying drawings, wherein.

Figure 1:
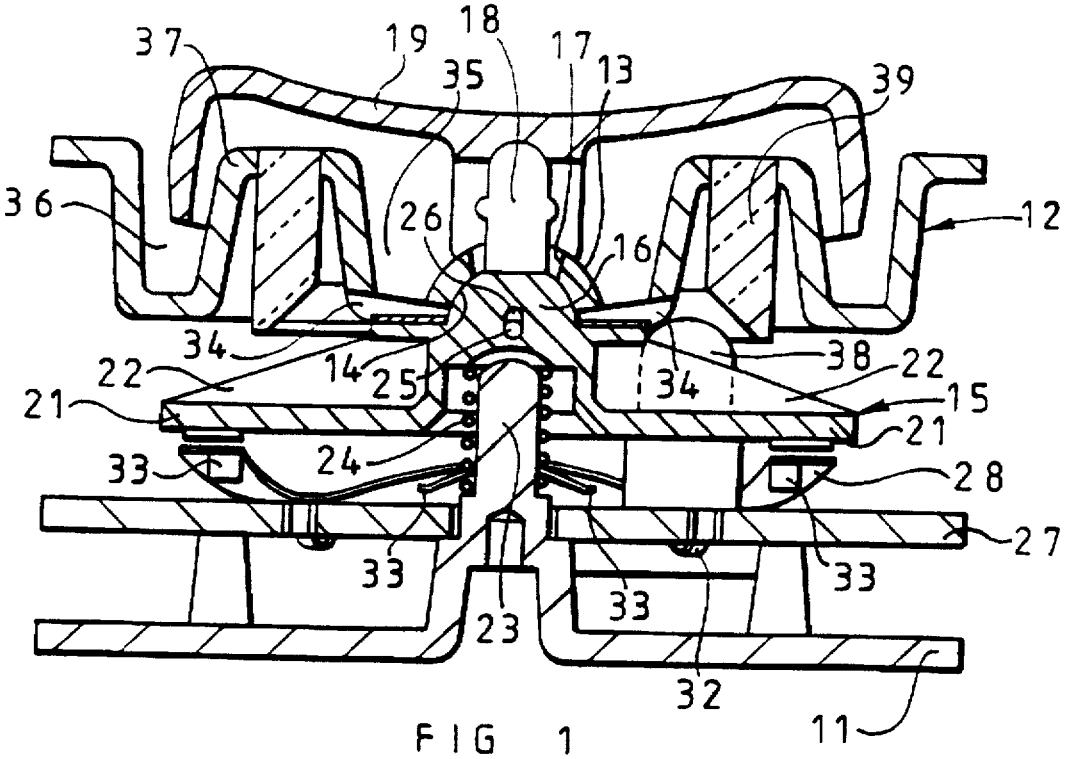
FIG. 1 is a diagrammatic cross-sectional view of a four-way rocker switch.
Figure 2:
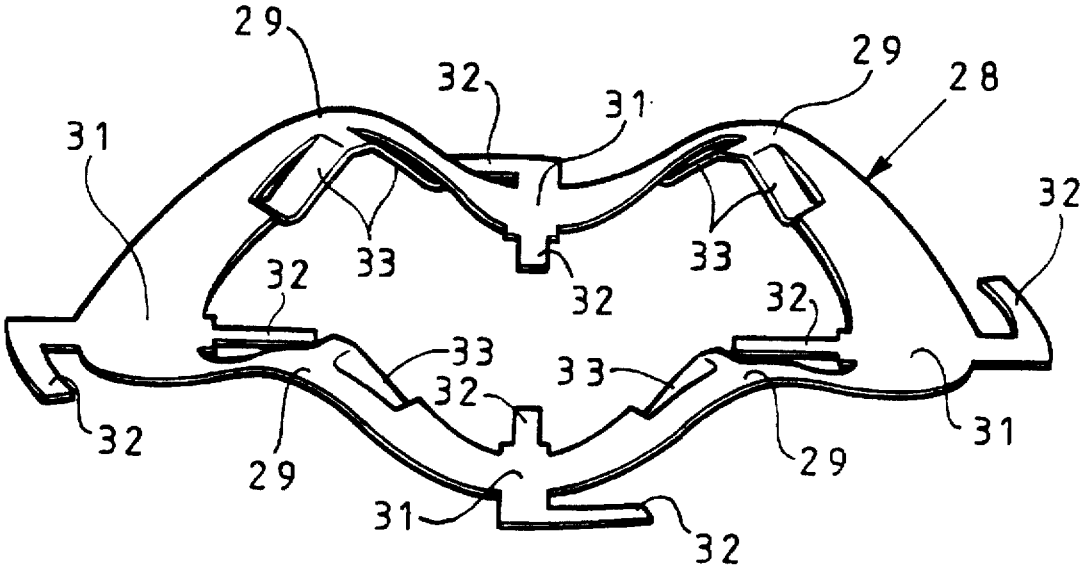
FIG. 2 is a perspective view of a contact element of the electrical switch of FIG. 1.

Referring to the drawings, the electrical switch includes a two-part moulded synthetic resin housing comprising a base 11 and a cover 12 fixed thereto. The base and the cover may be interconnected by way of integral side walls, or other fixing arrangements, and in the arrangement as illustrated in FIG. 1 both the base 11 and the cover 12 can continue beyond the immediate region of the switching mechanism according to the invention, to receive further switching modules.

The cover 12 is formed integrally with a domed region 13 presenting a part-spherical recess 14 towards the base 11. A moulded synthetic resin operating member 15 includes a part-spherical portion 16 seated, in the manner of a ball and socket joint, in the part-spherical recess 14. Integral with the portion 16 and extending therefrom through an aperture 17 in the domed region 13, is a spigot 18 receiving a moulded synthetic resin rocker member 19 as a snap-fit. The rocker member 19 forms part of the operating member 15 and lies at the exterior of the cover 12 for manual actuation.

Integral with the part-spherical portion 16 of the operating member 15 and disposed between the cover 12 and the base 11 are four equiangularly spaced co-planar arms 21 radiating outwardly from the axis of the portion 16 and spigot 18. Integral triangular webs or fillets 22 unite the upper surface of each arm 21 and an integral circular flange adjacent the base of the portion 16 and serve to support the arms 21 against flexure.

Integral with the base 11 and upstanding therefrom is a post 23 the uppermost end of which is rounded. The post 23 extends into a recess in the face of the operating member 15 presented towards the base and a helically wound compression spring 24, encircling the post 23, acts between the base 11 and the operating member 15 to urge the part-spherical portion 16 of the operating member into the recess 14. The post 23 is co-axial with the portion 16 and the spigot 18 and normally clearance exists between the upper end of the post 23 and the underside of the part-spherical portion 16. A transversely extending steel pivot pin 25 is anchored at its opposite ends in the wall of the domed region 13 and extends through a transversely extending bore 26 of the part-spherical portion 16. The bore 26 is enlarged in the direction of the axis of the post 23 such that in addition to the operating member 15 being able to pivot relative to the housing about the axis of the pivot pin 25, it can also pivot in a perpendicular plane as permitted by the axis of the bore 26 tilting relative to the axis of the pin 25.

Secured to the base 11, and disposed between the base 11 and the arms 21 of the operating member 15, is a rigid printed circuit board 27 apertured to receive the post 23. Secured to the board 27 and lying between the board 27 and the arms 21 is a contact element in the form of a beryllium copper annulus 28. The annulus is formed from sheet material, and is shaped as so to have a wavy, or sinuous, configuration rather than being of planar form. The shaping of the annulus is akin to a sine wave and has four equiangularly spaced crests 29 and four equiangularly spaced troughs 31, the troughs 31 being equally spaced between adjacent crests 29.

Adjacent each trough the annulus 28 includes integral legs 32 which are bent and soldered to the printed circuit board 27 to hold the annulus in position relative to the circuit board 27, the positioning of the annulus being such that each crest 29 is spaced from the upwardly presented surface of the printed circuit board and is disposed immediately beneath a respective arm 21 of the operating member 15. At each crest 29 the inner periphery of the annulus 28 is partially severed to form a pair of contact fingers 33 angled downwardly towards the printed circuit board, and beneath each crest 29 the printed circuit board defines a contact area engageable by one or both of the fingers 33 upon flexure of the respective crest 29 downwardly towards the base 11. The free end regions of the fingers 33 are bent or curved upwardly to avoid end edge surfaces of the fingers engaging the board 27 and thus facilitating sliding engagement of each finger with the board as the respective crest 29 is flexed towards the board 27. At the points where the legs 32 of the annulus 28 pass through, and are soldered to, the board 27 there are contact regions to which the legs, and therefore the annulus 28 are electrically connected. The contact regions electrically connected to the legs 32 are all connected to a common conductive track on the printed circuit board and the four contact areas disposed beneath the crests 29 of the annulus 28 are each connected to respective conductive tracks of the board 27. The conductive tracks extend to terminal regions on the board whereby external electrical connections can be made to the switch.

It will be recognised that the switch has a rest position in which the plane of the arms 21 of the operating member 15 is parallel to the plane of the board 27 and all four crests 29 are spaced from the printed circuit board 27. Pressure can be applied, by an operator, to the rocker member 19 above one or other of the four crests 29 so that, dependent upon the point at which the rocker member 19 is pressed, the operating member either pivots about the axis of the pin 25, or alternatively rocks on the pin 25 as permitted by the enlargement of the bore 26. Thus dependent upon the position at which the operating member 19 is pressed the plane of the arms 21 will be tilted so that a respective one of the arms 21 will press its respective crest 29 downwardly towards the base thus engaging one or both of its contact fingers 33 with the respective contact area on the printed circuit board, and completing a respective electrical circuit through the switch. Upon release of pressure from the operating member 19 the resilience of the annulus 28 will, in conjunction with the spring 24, restore the operating member to its central rest position.

It will be recognised that in the switch construction described so far it would be possible to apply pressure to the operating member 19 between a pair of crests 29 with the attendant risk that both crests will be deflected simultaneously to complete respective electrical circuits. In order to prevent this possibility the housing 11, adjacent the dome 13 is provided with four equiangularly spaced slots 34 aligned with the four crests 29 of the annulus 28 respectively and into which a respective one of four equiangularly spaced ribs on the operating member 15, will enter as the operating member 15 is moved relative to the cover 12. Accordingly, if an attempt is made to depress the rocker member 19 at a point other than immediately above a respective crest 29 of the annulus 28 then such movement of the operating member will be prevented by the cooperation of the slots 34 and the corresponding ribs of the operating member. If desired the slots and ribs may have their edges chamfered so that if an attempt is made to depress the rocker member 19 at a point other than above a crest 29 then the movement of the operating member will be guided by cooperation of the nearest slot and rib to operate the nearest contacts.

It can be seen from FIG. 1 that the cover 12 is not a planar cover, having a well 35 within which the domed region 13 is located, a circular channel 36 surrounding the well 35 and concentric therewith, and an upstanding circular rib 37 separating the channel 36 from the well 35. The rocker member 19, which is of disc-like configuration, overlies the well 35 and the rib 37 and has a downwardly extending peripheral flange lying within the channel 36. The material of the rocker member 19 is translucent, and in order to provide illumination of the switch there is provided a light source 38, conveniently a bulb, carried by the printed circuit board 27 and powered through respective tracks on the printed circuit board. The bulb 38 extends towards the cover 12 between adjacent arms 21 of the operation member 15 and light from the bulb 38 is received by an annular light pipe 39 formed from transparent material and secured to the rib 37 of the cover. One face of the annular light pipe 39 is exposed through an aperture in the rib 37 and thus light from the bulb 38 enters the light pipe through an angled surface thereof and is distributed by internal reflection around the light pipe to issue from the annular upper surface of the light pipe exposed at the surface of the rib 37, to illuminate the translucent rocker member 19.

It will be understood that the use of a single annular member 28 to define the moving contacts of the four contact sets of the switch, and also to define parts of the return spring mechanism of the switch greatly reduces the parts count of the switch, and thus improves the economy of manufacture and assembly of the switch. It will further be recognised that although in the example described above the switch is a four-way switch the same principle of construction can be used in three-way switches (in which case the annulus 28 would have three equiangularly spaced crests interspaced by three equiangularly spaced troughs) or multi-way switches having five or more operating directions.

Although in the example described above the annulus 28 is permanently electrically connected to a respective track of the printed circuit board and thus the contact fingers 33 are "live" or "earth" contacts, it would be possible to produce a switch in which the annulus 28 was not electrically connected to a track on the printed circuit board 27, and instead each finger 33 of a pair of fingers was engagable with a respective contact area on the printed circuit board 27 so that the two fingers would bridge their respective contact areas to complete an electrical circuit. It will be recognised that in such an arrangement it would not be necessary for the annulus itself to be formed from electrically conductive material and thus it would be possible to use a synthetic resin annulus carrying conductive components or conductive areas to form the bridging contacts.

I claim:

1. An electrical switch comprising a housing, an operating member mounted on the housing for movement from a rest position in at least three different directions relative to the housing, and at least three electrical contact sets operable respectively by movement of the operating member from said rest position in a respective one of said three directions, each of said contact sets comprising a movable contact member and corresponding fixed contact means, each of said movable contact members being carried by a common, resilient annulus, said fixed contact means of said contact sets being disposed on a planar member, and, said annulus being sinuous having equiangularly-spaced crests and equiangularly-spaced intervening troughs, the annulus having a median plane which is disposed generally parallel to said planar member, and, said movable contact members being associated with said crests of said annulus so as to be spaced from said planar member when said operating member is in its rest position.

2. A switch as claimed in claim 1, wherein said annulus is anchored, adjacent its troughs, to said planar member.

3. A switch as claimed in claim 1, wherein said annulus has four equiangularly spaced crests and four equiangularly spaced troughs, the troughs being equiangularly spaced between the crests.

4. A switch as claimed in claim 1, wherein said housing and said operating member cooperate to define planes of permitted movement of the operating member relative to the housing.

5. A switch as claimed in claim 4, wherein said operating member has four permitted directions of movement relative to the housing.

6. A switch as claimed in claim 1, wherein said annulus is electrically conductive and said movable contact members are integral parts thereof.

* * * * *